US009469996B2

(12) United States Patent
Ma

(10) Patent No.: US 9,469,996 B2
(45) Date of Patent: Oct. 18, 2016

(54) RETRACTABLE AWNINGS

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 18 days.

(21) Appl. No.: 13/793,413

(22) Filed: Mar. 11, 2013

(65) Prior Publication Data

US 2014/0251552 A1 Sep. 11, 2014

(51) Int. Cl.
*E04F 10/04* (2006.01)
*E04F 10/06* (2006.01)

(52) U.S. Cl.
CPC ..... *E04F 10/04* (2013.01); *E04F 10/0603* (2013.01); *E04F 10/0618* (2013.01); *E04F 10/0651* (2013.01); *E04F 10/0655* (2013.01); *E04F 10/0692* (2013.01)

(58) Field of Classification Search
CPC ..... E05F 10/0618; E05F 10/0622
USPC ..... 160/66, 67, 70, 79
See application file for complete search history.

(56) References Cited

U.S. PATENT DOCUMENTS

| | | | | |
|---|---|---|---|---|
| 2,740,470 | A | 4/1956 | D'Azzo | |
| 3,782,443 | A | 1/1974 | Clauss et al. | |
| 3,923,074 | A | 12/1975 | Mckee | |
| 3,991,805 | A | 11/1976 | Clauss | |
| 4,479,526 | A | 10/1984 | Rinaldi et al. | |
| 4,566,516 | A | 1/1986 | Lohausen | |
| 4,590,642 | A | 5/1986 | Hesener | |
| 4,673,017 | A | 6/1987 | Lauzier | |
| 4,784,204 | A | 11/1988 | Lohausen | |
| 4,953,609 | A * | 9/1990 | Annin et al. | 160/24 |
| 5,029,363 | A | 7/1991 | Hesener | |
| 5,133,397 | A | 7/1992 | Lohausen | |
| 5,139,068 | A | 8/1992 | Lohausen | |
| 5,273,095 | A | 12/1993 | Lukos | |
| 5,307,856 | A | 5/1994 | Murray | |
| 5,365,989 | A | 11/1994 | Bodentien et al. | |
| 5,394,921 | A | 3/1995 | Lohausen | |
| 5,752,556 | A | 5/1998 | Steadman | |
| 6,024,152 | A | 2/2000 | Rosenich | |
| 6,216,762 | B1 * | 4/2001 | Lin | 160/370.22 |

(Continued)

FOREIGN PATENT DOCUMENTS

| | | |
|---|---|---|
| CH | 625300 | 9/1981 |
| DE | 2613583 | 3/1976 |

(Continued)

OTHER PUBLICATIONS

Partial European Search Report in Application No. EP 09 25 1792, dated Nov. 3, 2011 in 7 pages.

(Continued)

*Primary Examiner* — Blair M Johnson
(74) *Attorney, Agent, or Firm* — Knobbe, Martens, Olson & Bear, LLP

(57) ABSTRACT

An awning is provided that includes a canopy. The awning includes a canopy frame. The canopy frame includes an inner member configured to be mounted to an upright support such as an exterior wall. The canopy frame also includes a first foldable arm and a second foldable arm. Each of the arms includes an inner portion coupled with the inner member and an outer portion. The canopy frame also includes an outer member coupled with the outer portions of each of the first and second foldable arms. The canopy frame is configured such that upon initial retraction of the canopy, the first foldable arm begins folding prior to the second foldable arm.

21 Claims, 7 Drawing Sheets

(56) References Cited

U.S. PATENT DOCUMENTS

| | | | | |
|---|---|---|---|---|
| 6,484,069 | B2 | 11/2002 | Ab | |
| 6,598,612 | B1 | 7/2003 | Crowe | |
| 6,732,018 | B2 | 5/2004 | Ab | |
| 6,739,371 | B2 | 5/2004 | Mukai | |
| 6,874,558 | B2 | 4/2005 | Mester | |
| 6,904,826 | B2 | 6/2005 | Hesener | |
| 7,163,042 | B2 * | 1/2007 | Li | E04F 10/0618 160/22 |
| 7,628,194 | B2 * | 12/2009 | Wagner et al. | 160/22 |
| 8,141,613 | B2 | 3/2012 | Brutsaert | |
| 8,205,656 | B2 | 6/2012 | Ma | |
| 8,316,910 | B2 | 11/2012 | Popa et al. | |
| 2001/0027846 | A1 | 10/2001 | Osinga | |
| 2004/0016511 | A1 | 1/2004 | Mester | |
| 2007/0193700 | A1 | 8/2007 | Ornelas et al. | |
| 2007/0199662 | A1 | 8/2007 | Miller | |
| 2010/0032106 | A1 | 2/2010 | Ma | |
| 2012/0273144 | A1 | 11/2012 | Forns | |
| 2013/0118696 | A1 * | 5/2013 | Gavish | 160/328 |
| 2013/0126104 | A1 | 5/2013 | Weber | |

FOREIGN PATENT DOCUMENTS

| | | |
|---|---|---|
| DE | 27 43 748 | 4/1979 |
| EP | 1342864 | 9/2003 |
| FR | 2 163 097 | 7/1973 |
| FR | 2564521 | 11/1985 |
| JP | S62-146828 | 9/1987 |

OTHER PUBLICATIONS

Extended European Search Report in Application No. EP 09 25 1792, dated Feb. 2, 2012 in 11 pages.

Extended European Search Report issued in European Application No. 14158518.2, dated May 16, 2014 in 9 pages.

* cited by examiner

RETRACTABLE AWNINGS

BACKGROUND OF THE INVENTION

1. Field of the Invention

This invention is directed to the field of outdoor leisure sunshades, in particular, to window awnings and retractable arms and mechanisms for the same.

2. Description of the Related Art

Awnings are well known for providing shade and shelter. In particular, awnings are available that include a frame that supports a shade or shelter providing member (sometimes called a "canopy" herein). The frame is attached to a support surface such as an exterior wall of a building. In a basic form, an awning is installed and remains in the same position and configuration at all times.

Some more advanced awnings have retractable frames that allow the user to extend and retract the canopy. The mounting space and the length of the area to be shaded (e.g., a window) determine the length of the roller tube of the awnings that are currently used in the market. In order for arms of the retractable mechanism to retract or fold smoothly, the existing devices are configured to retract both sets of arms simultaneously. The front and rear arms after extension are slightly longer than the length of the roller tube. If there is a need to increase the area shaded by the arms, the two sets of arms will not be able to retract properly as they will interfere with each other based on the existing arm mechanisms.

SUMMARY OF THE INVENTION

Although retractable awnings are more advanced, the mechanisms that enable folding and unfolding are not satisfactory. The new awning structures described herein are able to expand the area shaded by an awning mounted on a window of a restricted size. This enables awnings to fold more compactly so that retractable awnings can be used in more settings.

One of several independent objectives of some of the embodiments discussed herein is to provide a structurally simple, easy to operate and affordable window awning that is able to expand the shaded area of a narrow window, and that is suitable for large-scale application.

Broadly, mechanisms are provided whereby the folding of the arms is not completely synchronous, but rather in which one arm begins folding before the other.

In one embodiment, an awning is provided that includes a canopy. The canopy has a width and an extended length when fully extended. The awning also includes a canopy frame. The canopy frame includes an inner member configured to be mounted to an upright support such as an exterior wall. The canopy frame also includes a first foldable arm and a second foldable arm. Each of the arms includes an inner portion coupled with the inner member and an outer portion. The canopy frame also includes an outer member coupled with the outer portions of each of the first and second foldable arms. The canopy frame is configured such that upon initial retraction of the canopy, the first foldable arm begins folding prior to the second foldable arm.

In some embodiments each of the first and second foldable arms includes a linkage. Each of the linkages includes a plurality of links. Each of the plurality of links includes an outer link coupled with the outer member and an inner link coupled with the inner member. Each of the linkages includes a pivot joint between the inner and outer links.

In some embodiments, the second foldable arm includes a pivoting connection between one of [a] the inner link and the inner member and [b] the outer link and the outer member. The second foldable arm also includes a sliding connection between the other of [a] the inner link and the inner member and [b] the outer link and the outer member.

In some embodiments, the second foldable arm includes a pivoting connection between one of [a] the inner link and the inner member and [b] the outer link and the outer member. The second foldable arm also includes a telescoping portion adjacent to the connection between the other of [a] the inner link and the inner member and [b] the outer link and the outer member.

In some embodiments, the first foldable arm includes pivoting connections between the inner link and the inner member and between the outer link and the outer member.

In some embodiments, the second foldable arm includes a pivoting connection between one of [a] the inner link and the inner member and [b] the outer link and the outer member. The second foldable arm also includes a translatable connection between the other of [a] the inner link and the inner member and [b] the outer link and the outer member.

In some embodiments, a sliding joint is provided between the outer link and the outer member. The translatable connection also includes a roller disposed in the outer member.

In some embodiments, the outer link includes a tubular portion and a member received within the tubular portion. A compressible member is disposed between the tubular portion and the member received therein. The compressible member compresses during an initial retraction of the canopy. During the initial retraction, the first foldable arm is folded.

In some embodiments, an awning is provided that includes a canopy. The canopy has a width and an extended length when fully extended. The awning also includes a canopy frame. The canopy frame includes an inner member configured to be mounted to an upright support such as an exterior wall. The canopy frame also includes a first foldable arm and a second foldable arm. Each of the arms includes an inner portion coupled with the inner member and an outer portion. The canopy frame also includes an outer member coupled with the outer portions of each of the first and second foldable arms. The canopy frame is configured such that when the canopy is retracted a portion of the first foldable arm is received within a bight formed between the inner member and the second foldable arm.

In some embodiments, the inner member extends along a longitudinal axis. The inner portion of the first foldable arm is coupled to the inner member to pivot about a first axis. The inner portion of the second foldable arm is coupled to the inner support member to pivot about a second axis. A first distance is defined from the longitudinal axis of the inner member to the first axis. A second distance is defined from the longitudinal axis of the inner member to the second axis. The second distance is greater than the first distance by an amount greater than the folded size of the first foldable arm.

In some embodiments, a connection between the second foldable arm and one of the inner member and the outer member minimizes the folding of the second arm during an initial retraction of the canopy. A connection between the first foldable arm and one of the inner member and the outer member induces folding of the first arm during the initial canopy retraction.

In some embodiments, each of the first and second foldable arms comprises a pivot disposed in a central portion thereof. Upon folding, the pivot of the first foldable arms is displaced from a first position to a second position. The first position is disposed laterally of the second arm and the second position is disposed between the second arm and the inner member.

In some embodiments, upon folding, the pivot of the second foldable arms is displaced from a first position to a second position. The first position is disposed laterally of the first arm and the second position is disposed between the first arm and the outer member.

In some embodiments, an awning is provided that includes a canopy. The canopy has a width and an extended length when fully extended. The awning also includes a canopy frame. The canopy frame includes an inner member configured to be mounted to an upright support such as an exterior wall. The canopy frame also includes a first foldable arm and a second foldable arm. Each of the arms includes an inner portion coupled with the inner member and an outer portion. The canopy frame also includes an outer member coupled with the outer portions of each of the first and second foldable arms. The canopy frame is configured such that when the canopy is retracted, the first and second foldable arms overlap each other in a horizontal plane.

In some embodiments, the first arm is pivotally connected to the inner member at a first inner pivot. The first arm is pivotally connected to the outer member at a first outer pivot. The second arm is pivotally connected to the inner member at a second inner pivot. The second arm is pivotally connected to the outer member at a second outer pivot. The distance from the inner member to the first inner pivot is less than the distance from the inner member to the second inner pivot.

In some embodiments, the distance from the outer member to the first outer pivot is greater than the distance from the outer member to the second outer pivot.

In some embodiments, the second foldable arm is coupled with the outer member at the second outer pivot and rotates about an axis that extends through the outer member.

In some embodiments, the awning further includes an off-set coupling having an outer portion coupled with the outer member. The off-set coupling has an inner portion. The inner portion includes a portion of the first outer pivot enabling an outer portion of the first foldable arm to pivot relative to the outer member.

In some embodiments, two sets of arms are arranged in tandem (e.g., substantially parallel) when expanded. The outer end of at least one of the arms is retractable relative to (e.g., telescoping in) a portion of the arm located inward of the outer end.

In some embodiments, two sets of arms are arranged in tandem (e.g., substantially parallel) when expanded. The outer end of at least one of the arm can be coupled with a moving (e.g., sliding) structure that can move in a groove located in an outer frame member (e.g., a front beam).

In some embodiments, two sets of arms are arranged in tandem (e.g., substantially parallel) when expanded. The outer end of at least one of the arm can be coupled with a moving (e.g., sliding) structure that can move in a groove located in an outer frame member (e.g., a front beam).

In some aspects, at least one spacer (e.g., in the form of a wall mounting bracket) provides space needed for the retraction of at least a portion of at least one of the arms to a position at least partially received within the other arm.

In some aspects, at least one spacer (e.g., in the form of a connecting block) provides space needed for the retraction of the other arm between at least a portion of one of the arms and an outer frame member (e.g., a front beam) to enable at least a portion of one of the arms to be at least partially received in the space.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Figure 1:
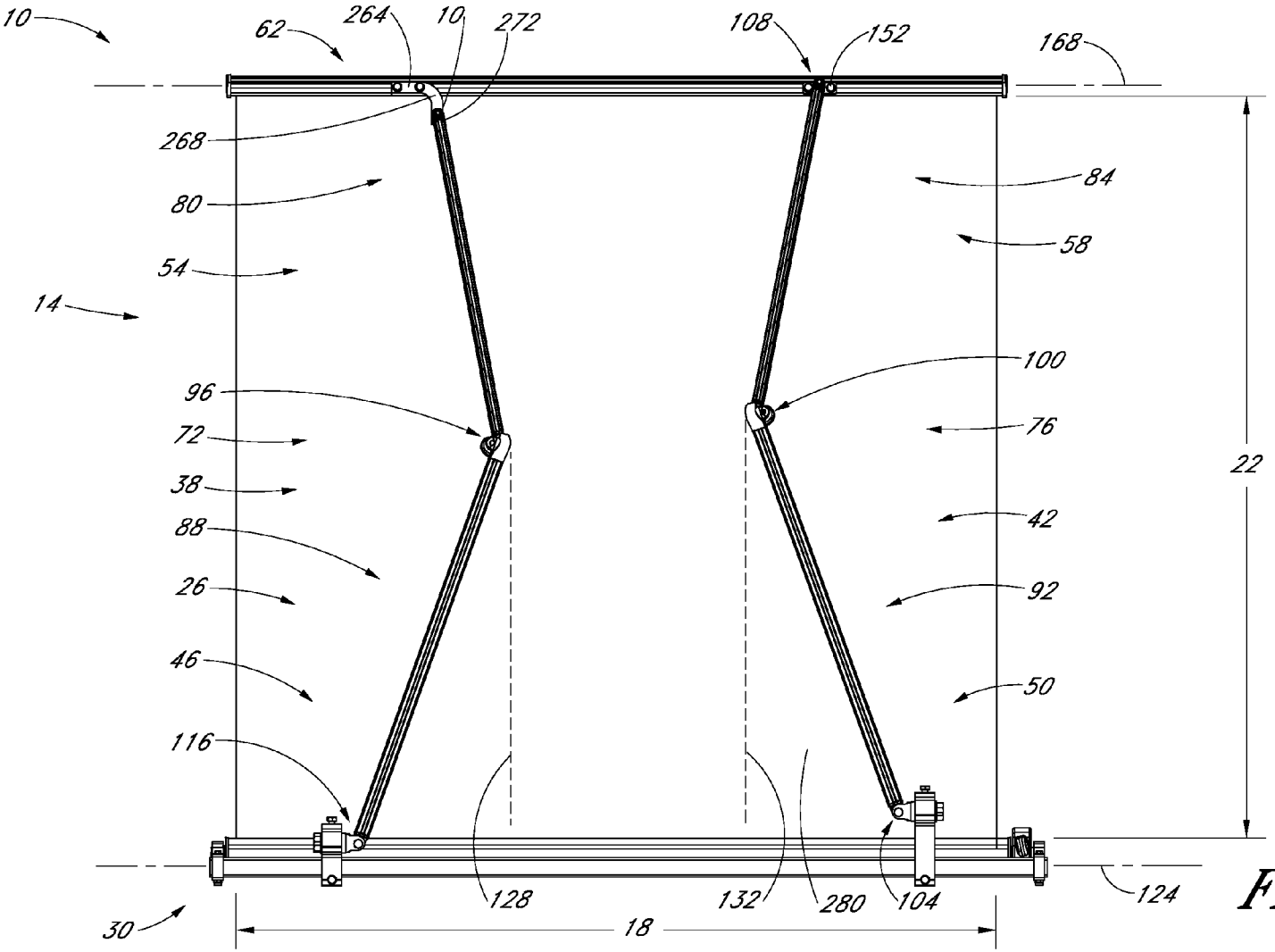
FIG. 1 is a bottom view of a first embodiment of an awning in accordance with this application, shown in an extended configuration.

FIG. 1 illustrates an embodiment of an awning 10. The awning 10 comprises a canopy 14. The canopy 14 has a width 18 and an extended length 22 when the canopy 14 is fully extended. The awning 10 includes a canopy frame 26. The canopy frame 26 includes an inner member 30 (e.g., support pole, shaft, etc). The inner member 30 is configured to be mounted to an upright support (e.g., a wall, window, etc). The canopy frame 26 includes a first foldable arm 38 and a second foldable arm 42. Each of the first and second foldable arms 38, 42 include inner portions 46 and 50, respectively. In some embodiments, the inner portions 46, 50 include links. Each of the inner portions 46, 50 are coupled with the inner member 30. Each of the first and second foldable arms 38, 42 include outer portions 54, 58, respectively. In some embodiments, the outer portions 54, 58 include links. Each of the outer portions 54, 58 of the first and second foldable arms 38, 42 are coupled with an outer member 62 (e.g., front beam).

In some embodiments, each of the first and second foldable arms 38 and 42 comprise linkages 72 and 76, respectively. Each of the linkages 72 and 76 can include a plurality of links. Each of the plurality of links includes outer links 80 and 84 coupled with the outer member 62. Each of the plurality of links includes inner links 88 and 92 coupled with the inner member 30. Each of the plurality of links includes pivot joints 96 and 100 between the respective inner links 88 and 92 and outer links 80 and 84. The pivot joints 96 and 100 allow the inner links 88 and 92 and outer links 80 and 84 to pivot about or rotate relative to each other. This enables the first and second foldable arms 38 and 42 to move between fully retracted (e.g., folded) positions and fully extended (e.g., unfolded) positions and any position therebetween. A user can selectively retract or expand the canopy 14 to provide a desired area or amount of shade or shelter.

Figure 2:
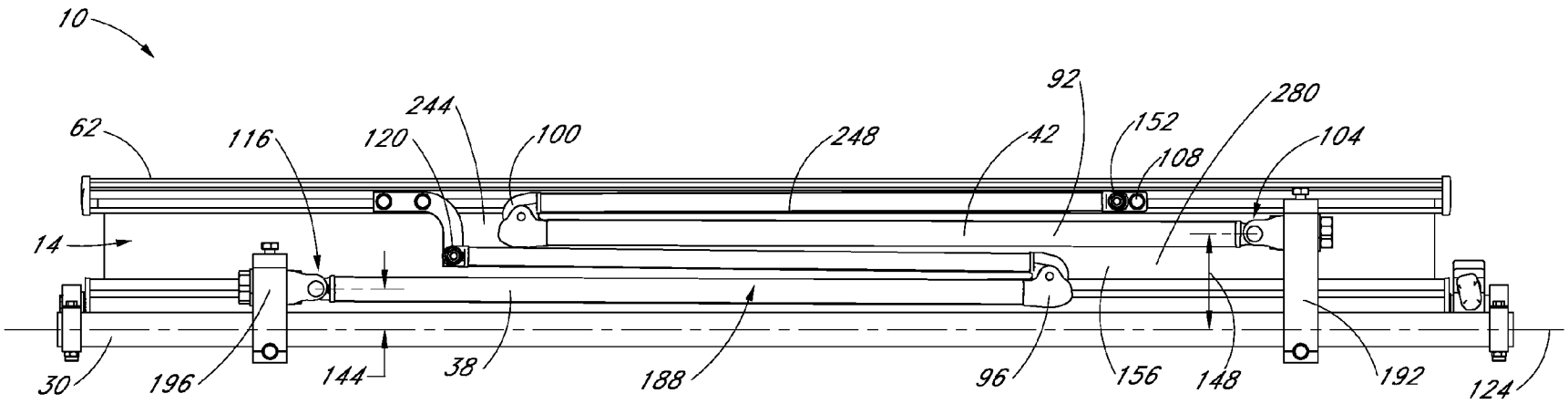
FIG. 2 is a bottom view of the embodiment of FIG. 1 in a retracted configuration.
Figure 3:
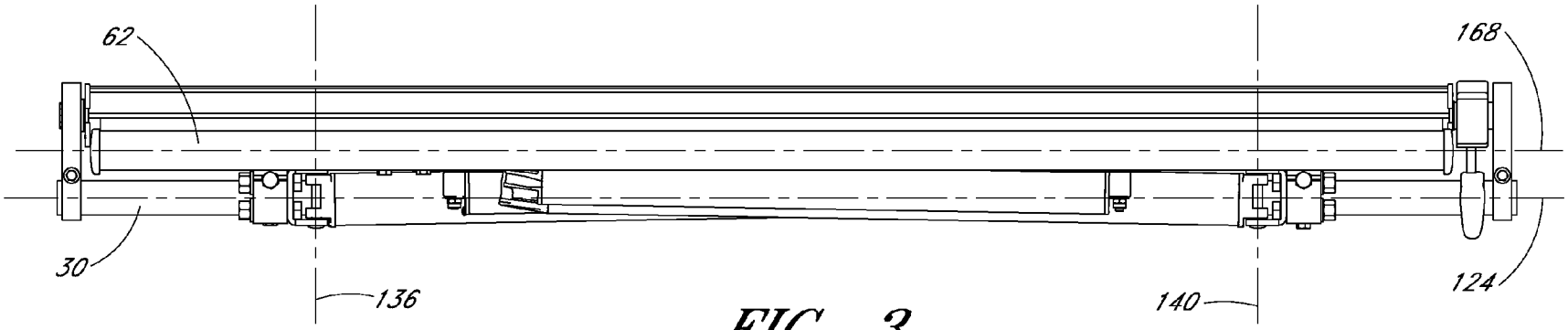
FIG. 3 is a front view of the embodiment of FIG. 1 in a retracted configuration.

In some embodiments, as illustrated in FIG. 2, the canopy frame 26 is configured such that when the canopy 14 is retracted, the first and second foldable arms 38 and 42 overlap each other in a horizontal plane.

In some embodiments, pivot joints 96 and 100 are disposed at central portions of first and second foldable arms 38 and 42, respectively. In some embodiments, upon folding or retracting of the first foldable arm 38, the pivot joint 96 is displaced from a first position to a second position. In the first position, the pivot joint 96 is disposed laterally from the second foldable arm 42 as illustrated in FIG. 1. In the second position, the pivot joint 96 is disposed between the second foldable arm 42 and the inner member 30 as illustrated in FIG. 2.

In some embodiments, upon folding or retracting of the second foldable arm 42, the pivot joint 100 is displaced from a first position to a second position. In the first position, the pivot joint 100 is disposed laterally from the first foldable arm 38 as illustrated in FIG. 1. In the second position, the pivot joint 100 is disposed between the first foldable arm 38 and the outer member 62 as illustrated in FIG. 2.

In some embodiments, the inner member 30 extends along a longitudinal axis 124. The longitudinal axis 124 extends through first and second ends of the inner member 30. The inner portion 46 of the first foldable arm 38 is coupled to the inner member 30 to pivot about a first axis 136. The inner portion 50 of the second foldable arm 42 is coupled to the inner member 30 to pivot about a second axis 140. A first distance 144 is defined from the longitudinal axis 124 of the inner member 30 to the first axis 136. A second distance 148 is defined from the longitudinal axis 124 of the inner member 30 to the second axis 140. The second distance 148 is greater than the first distance 144 by an amount greater than a folded or fully retracted size of the first foldable arm 38 as illustrated in FIG. 2. In some embodiments, the second distance 148 can be equal to or greater than the length or width of pivot joint 96.

In some embodiments, a gap 280 is defined between an inner side surface of member 30 and a side surface of inner link 92. The inner side surface of member 30 faces the outer member 62. The side surface of inner link 92 faces the inner member 30 when the awning is in the closed or retracted position. The second distance 148 can be equal to or greater than the gap 280 when the awning is in the closed or retracted position, such that when the awning is in the closed or retracted position, the gap 280 is large enough to receive at least a portion of the folded first foldable arm 38. In some embodiments, the first foldable arm 38 has a width projecting away from the gap 280.

In some embodiments, the first foldable arm 38 pivots about the first axis 136 via a pivoting connection 116 between the inner link 88 and the inner member 30. The second foldable arm 42 pivots about the second axis 140 via a pivoting connection 104 between the inner link 92 and the inner member 30. The second distance 148 is configured to be greater than the first distance 144 as the second axis 140 is positioned closer to the outer member 62 than is the first axis 136. In other words, a vertical plane parallel to the longitudinal axis and intersecting the second axis 140 is disposed between the first axis 136 and the outer member 62.

As illustrated in FIGS. 1-2, the pivoting connection 104 can be coupled to a portion of a second spacer 192 (e.g., wall mounting bracket) coupled to the inner member 30. The pivoting connection 116 can be coupled to a portion of a first spacer 196 (e.g., wall mounting bracket) coupled to the inner member 30. The second spacer 192 extends in a direction towards the outer member 62 by a length equal to the second distance 148. The first spacer 196 extends in a direction towards the outer member 62 by a length equal to or greater than the first distance 144. Therefore, the second pivoting connection 104 is positioned closer to the outer member 62 than is the first pivoting connection 116. A vertical plane parallel to the longitudinal axis and intersecting the second pivoting connection 104 is disposed between the first pivoting connection 116 and the outer member 62. As such, when the canopy 14 is retracted, a bight 156 is formed between inner link 92 of the second foldable arm 42 and the inner member 30. In this embodiment, the bight 156 extends along a side surface of the inner link 92, a side surface of the second spacer 192, and a side surface of the inner member 30. The side surfaces of the inner link 92 and the second spacer 192 each face the first foldable arm 38 in at least one of the open or closed positions. The side surface of the inner member 30 faces the outer member 62.

As illustrated in FIG. 2, in some embodiments, the canopy frame 26 is configured such that when the canopy 14 is retracted, a portion 188 of the first foldable arm 38 is received within the bight 156 (e.g., space, recess, etc.) formed between the inner member 30 and the second foldable arm 42. More particularly, a substantial portion of the first foldable arm 38 is disposed in the bight 156. For example, the pivot joint 96 can be disposed in the bight 156 when the canopy frame 26 is retracted or folded. In some embodiments, the pivot joint 96 and a substantial length of, e.g., the majority of, the length of the linkage 72 can be disposed in the bight 156 when the canopy frame 26 is retracted or folded. In one embodiment, the linkage 72 includes outer and inner links 80, 88 pivotably coupled to the joint 96 and a majority of both links 80, 88 are disposed in the bight 156 when the canopy frame 26 is folded or retracted.

In some embodiments, in a similar fashion as discussed relative to the inner member 30, a bight 244 (e.g., space, recess, etc.) is formed between the outer member 62 and the first foldable arm 38. The canopy frame 26 is configured such that when the canopy 14 is retracted, a portion 248 of the second foldable arm 42 is received within the bight 244. More particularly, a substantial portion of the second foldable arm 42 is disposed in the bight 244. For example, the pivot joint 100 can be disposed in the bight 244 when the canopy frame 26 is retracted or folded. In some embodiments, the pivot joint 100 and a substantial length of, e.g., the majority of, the length of the linkage 76 can be disposed in the bight 244 when the canopy frame 26 is retracted or folded. In one embodiment, the linkage 76 includes outer and inner links 84, 92 pivotably coupled to the joint 100 and a majority of both links 84, 92 are disposed in the bight 244 when the canopy frame 26 is folded or retracted.

In some embodiments, the first foldable arm 38 includes the pivoting connection 116 between the inner link 88 and the inner member 30 and a pivoting connection 120 between the outer link 80 and the outer member 62. In some embodiments, the second foldable arm 42 includes the pivoting connection 104 between the inner link 92 and the inner member 30 and a pivoting connection 152 between the outer link 84 and the outer member 62.

Figure 4:
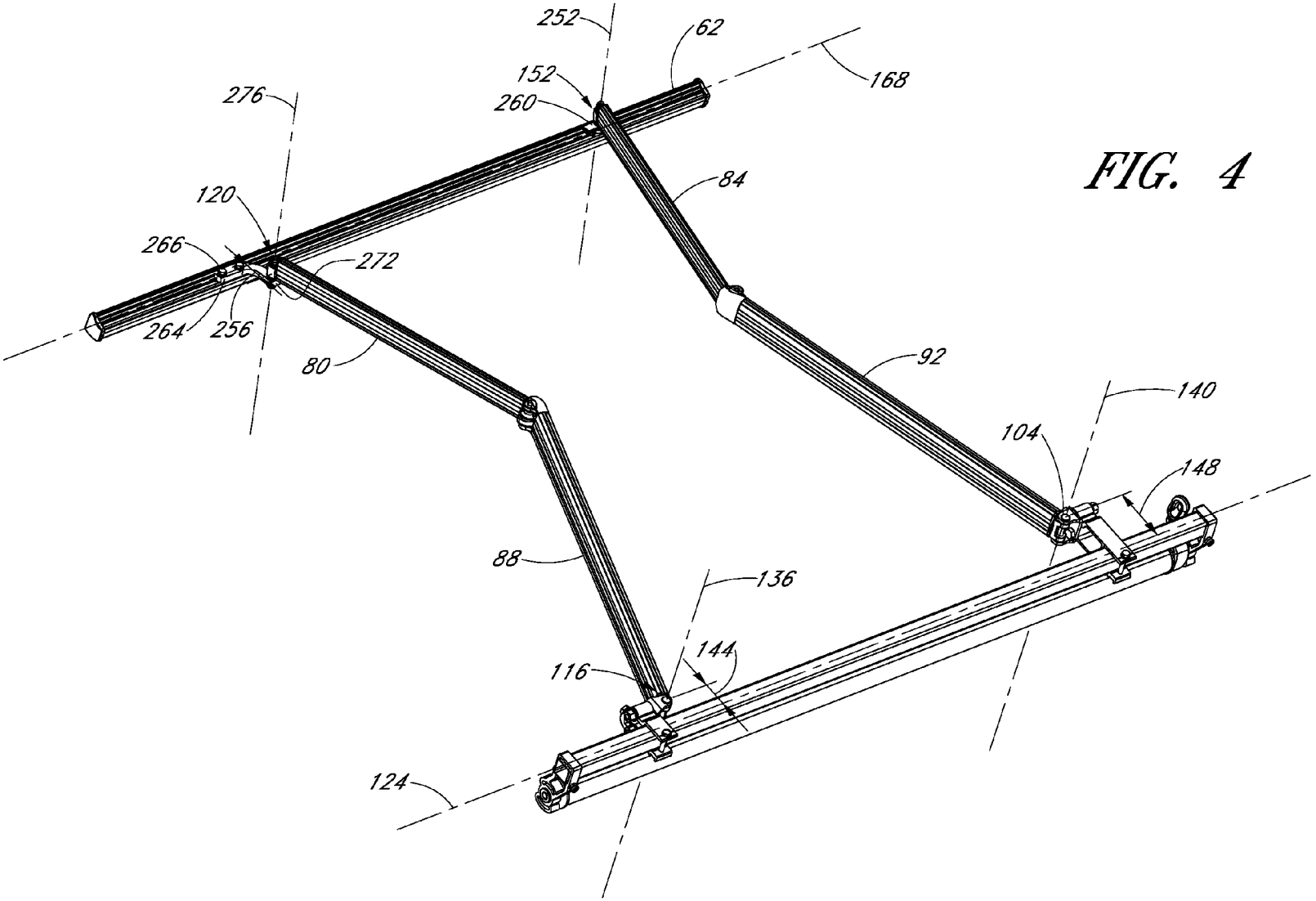
FIG. 4 is a rear perspective view of the embodiment of FIG. 1 with the translating connection removed from the channel to enhance the illustration.

In some embodiments, the distance 256 from the outer member 62 to the pivoting connection 120 is greater than the distance 260 from the outer member 62 to the pivoting connection 152. The distances 256 and 260 are defined from a longitudinal axis 168 of the outer member 62 and each respective pivoting connection 120 and 152. As illustrated in FIG. 4, in some embodiments, the distance 260 is greater than or equal to zero.

In some embodiments, the outer link 84 is coupled with the outer member 62 at the pivoting connection 152 such that outer link 84 is rotatable about an axis 252 that extends through the outer member 62.

In some embodiments, at least one spacer 264 (e.g., in the form of a connecting block) is provided that is coupled to the outer member 62 and the outer link 80. The spacer 264 extends away or is off-set from the outer member 62, such that the bight 244 is formed between the outer member 62 and the first foldable arm 38 upon retraction of the canopy 14.

In some embodiments, a first portion 266 of the spacer 264 is coupled with the outer member 62. A second portion 272 is off-set from the outer member 62 and includes the pivoting connection 120 between the outer member 62 and outer link 80. This configuration enables the outer link 80 to pivot relative to the outer member 62 about an axis 276 that does not extend through the outer member 62. The axis 276 can be located between the axes 168, 124 of the outer and inner members 62, 30 respectively.

In some embodiments, a third distance 128 is defined between the longitudinal axis 124 and the pivot joint 96 when the first foldable arm 38 is in the fully extended position. The third distance 128 extending along an axis that is transverse (e.g., perpendicular) to the longitudinal axis 124. A fourth distance 132 is defined between the longitudinal axis 124 and the pivot joint 100 when the second foldable arm 42 is in the fully extended position. The fourth distance 132 extending along an axis that is transverse (e.g., perpendicular) to the longitudinal axis 124. The fourth distance 132 is greater than the third distance 128.

In some embodiments, the first foldable arm 38 includes the pivoting connection 116 between the inner link 88 and the inner member 30 and a pivoting connection 120 between the outer link 80 and the outer member 62. In some embodiments, the second foldable arm 42 includes the pivoting connection 104 between the inner link 92 and the inner member 30 and a pivoting connection 152 between the outer link 84 and the outer member 62.

In some embodiments, the second foldable arm 42 includes a pivoting connection between one of (a) the inner link 92 and the inner member 30 and (b) the outer link 84 and the outer member 62. FIG. 1 illustrates the pivoting connection 104 between the inner link 92 and the inner member 30. The second foldable arm 42 includes a translatable connection 108 (e.g., sliding or rolling) between the other of (a) the inner link 92 and the inner member 30 and (b) the outer link 84 and the outer member 62. FIG. 1 illustrates the translatable connection 108 between the outer link 84 and the outer member 62. The translatable connection 108 permits pivoting between the other of (a) the inner link 92 and the inner member 30 and (b) the outer link 84 and the outer member 62.

In some embodiments, the translatable connection 108 includes one or more rollers 160 (e.g., sheaves) disposed in the outer member 62. The outer member 62 can include a channel or groove 164 extending along (e.g., intersected by or parallel to) the longitudinal axis 168 of the outer member 62. In some embodiments, the one or more rollers 160 are coupled to a sliding joint 172 provided between the outer link 84 and the outer member 62. The one or more rollers 160 enable the sliding joint 172 to translate within the channel 164 along the longitudinal axis 168. Thus, the translatable connection 108 enables the outer link 84 to slide or translate (e.g., roll) along the longitudinal axis 168 upon retraction of the canopy 14.

Figure 5A:
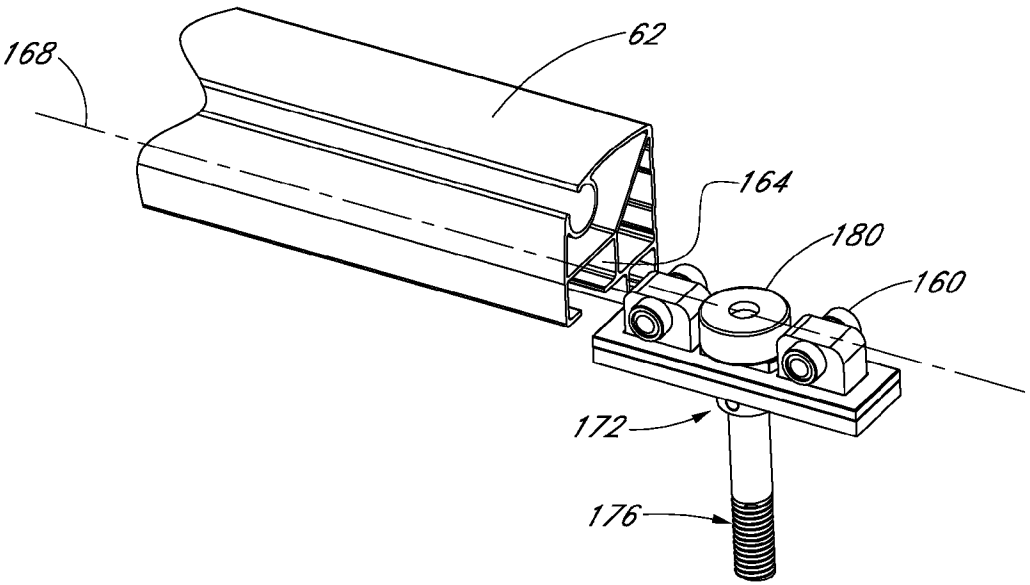
FIGS. 5A and 5B are exploded and cross-sectional views of an outer frame assembly of a feature 5A-5B from FIG. 1, showing a roller assembly used to control the folding operation of the awning.
Figure 5B:
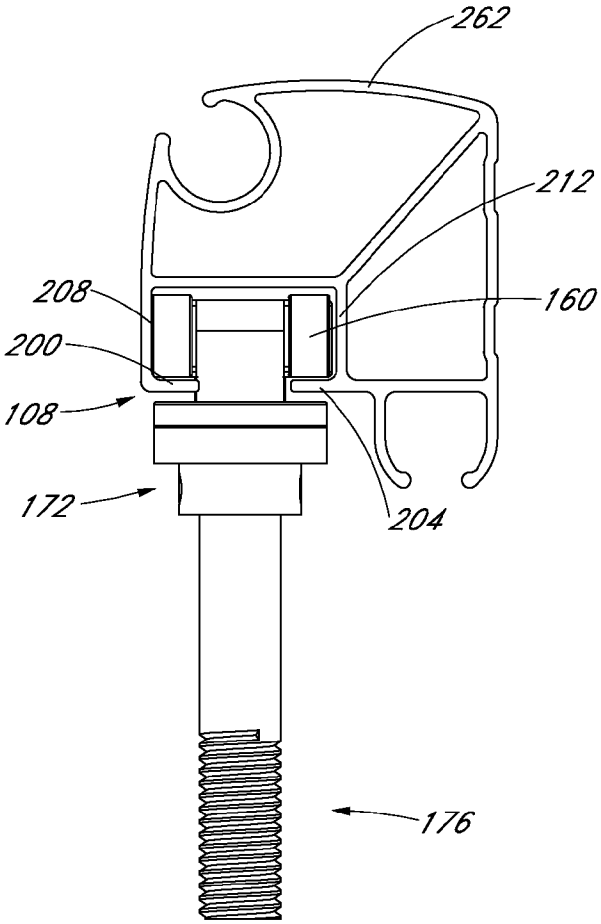

In some embodiments, as illustrated in FIGS. 5A-B, one or more rollers 160 can be coupled to an upper portion of the sliding joint 172. The one or more rollers 160 can be disposed within the channel 164 of the outer member 62. The channel 164 can include first and second inner flanges 200 and 204 extending towards each other from respective inner surfaces of anterior and posterior walls 208 and 212 of the channel 164. The first and second inner flanges 200 and 204 can extend along the channel 164. The channel 164 can be formed in part by lateral edges and/or upper surfaces of the flanges 200, 204. The one or more rollers 160 can slide, roll, or translate along the inner flanges 200 and 204.

In some embodiments, the outer link 84 can be pivotally connected to a bottom portion 176 of the sliding joint 172 at the pivoting connection 152. In some embodiments, the translatable connection 108 includes a roller 180 configured to rotate within the channel 164 about an axis extending through top and bottom surfaces of the channel 164. In some embodiments, the one or more rollers 160 are configured to rotate within the channel 164 about an axis extending through an inner surface facing the inner member 30 and an outer surface facing away from the inner member 30.

More generally, the translatable connection 108 can include a plurality of rolling supports. The rolling supports can be configured to roll or otherwise bear on support surfaces. At least one rolling support can be oriented horizontally and at least one can be oriented vertically in one embodiment. Support surfaces can be formed on the outer member 62 and thus move outwardly from the retracted to the extended positions with the outer member. The rollers permit low friction translation of the outer link 84 relative to the outer member 62. In particular, downward or upward forces can be borne by a plurality of (e.g., four) rollers acting on the upper surfaces of the flanges 200, 204 or by lower surfaces of the groove 164 facing the upper surfaces of the flanges 200, 204. These rollers are oriented vertically. Lateral forces directed outward during extending of the outer member 62 and inward during retraction of the outer member are applied between the roller 180, which is oriented horizontally. In various embodiments, one or more rollers can be oriented to apply forces primarily in a horizontal direction. In various embodiments, one or more rollers can be oriented to apply forces primarily in a vertical direction.

As discussed above, in some embodiments, the translatable connection 108 between the outer link 84 and the outer member 62 allows the outer link 84 to translate. Upon initial retraction of the canopy 14, the outer link 84 translates laterally away from the first foldable arm 38 along longitudinal axis 168. Translation of the second foldable arm 42 minimizes or delays folding of the second foldable arm 42 relative to folding of the first foldable arm 38 during initial retraction of the canopy 14. The first foldable arm 38 can include connections that are limited to pivoting, e.g., without any translation at the outer member 62. Upon initial retraction of the canopy 14, the pivoting connections 116 and 120 induce the first foldable arm 38 to fold during initial retraction of the canopy 14. Therefore, in some embodiments, the awning 10 is configured such that the first foldable arm 38 begins to fold prior to the second foldable arm 42 upon initial retraction of the awning 10. That is, in some embodiments, first and second foldable arms 38 and 42 do not fold synchronously upon initial retraction of the canopy 14. Rather, the first and second foldable arms 38 and 42 fold in a staggered fashion.

The extent of lateral movement of the translatable connection 108 can be limited. In one embodiment, the translatable connection 108 is configured to move along a lateral path having an end point. The end point can be defined by a stop member disposed within the channel 164. Contact of a portion of the translatable connection 108 with the stop member prevents further laterally outward motion of the translatable connection 108. Once this contact occurs, pivoting about the pivoting connections 104, 100, 152 dominate the folding of the second foldable arm 42. The travel of the translatable connection 108 between the position corresponding to fully extended until the translatable connection 108 reaches the stop member permits the second foldable arm 42 to be substantially fully extended while the first foldable arm 38 is folding. Upon reaching the end point of the travel path of the translatable connection 108, the first foldable arm 38 will have moved into the bight 156 in a partially retracted state. Further retraction of the outer member 62 causes the angle between the inner link 92 and the inner member 30 to decrease. This change in angle causes the bight 156 to surround a smaller area, e.g., reducing the gap 280. As the bight 156 becomes more compact, at least a portion of the first foldable arm 38, e.g., at least the pivot 96 moves further into the bight 156. In some embodiments, a limit on the lateral movement is provided by the component of forces directed laterally being less than internal resistance in the channel 164. For example when the force applied to the translatable connection 108 is substantially perpendicular to the orientation of the channel 164 little to no lateral force would be applied to urge the translatable connection 108 further laterally.

Figure 6:
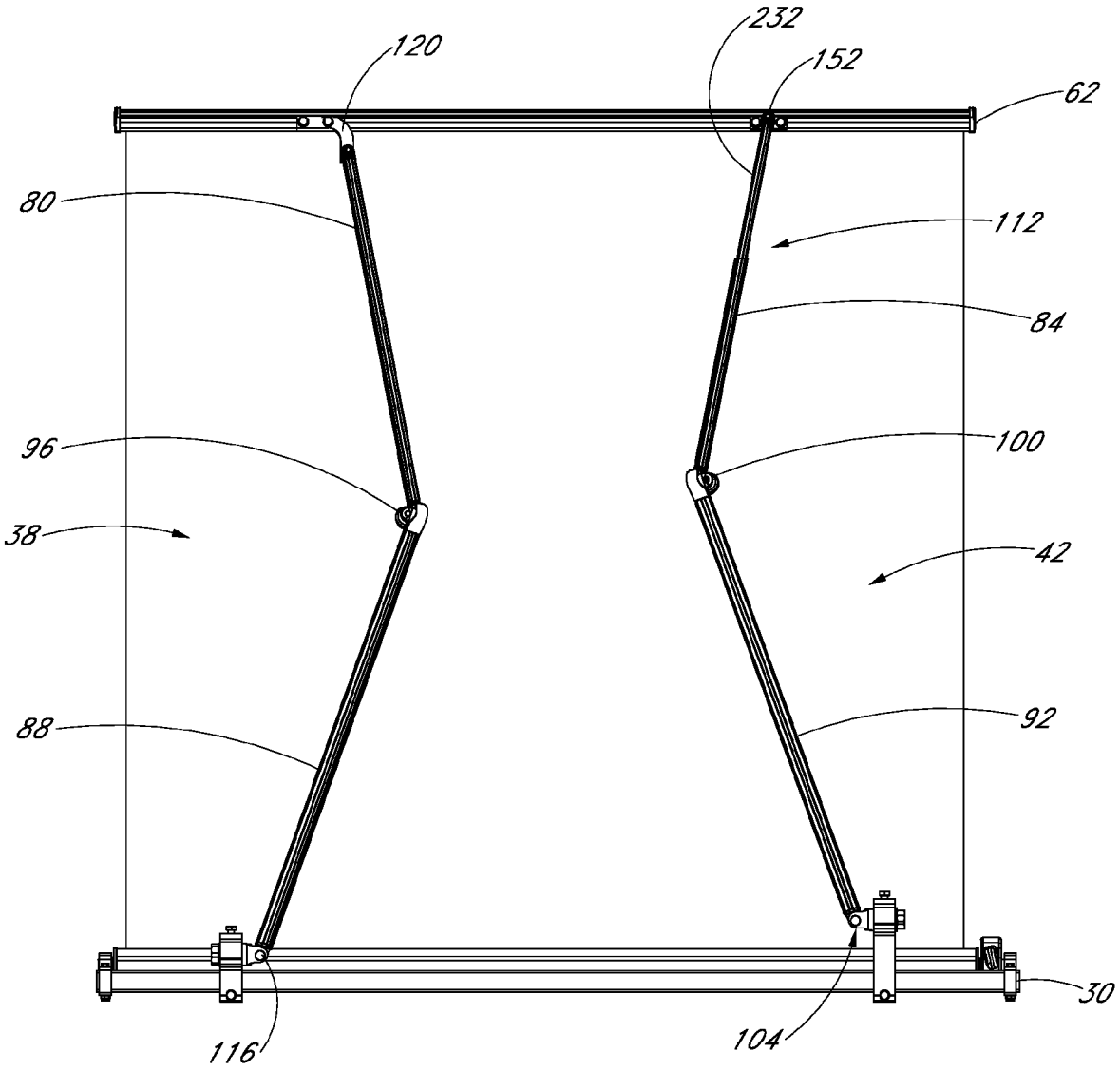
FIG. 6 is a bottom view of a second embodiment of an awning in accordance with this application, shown in an extended configuration.

FIG. 6 illustrates another embodiment of the awning 10 which can include one or more features of any of the embodiments described above. For example, in some embodiments, the awning 10 includes a first foldable arm 38 as configured in any of the embodiments discussed above.

In some embodiments, the second foldable arm 42 includes the pivoting connection 104 between the inner link 92 and the inner member 30. As illustrated in FIG. 6, the second foldable arm 42 includes a telescoping or retractable portion 112 adjacent to the connection 152 between the outer link 84 and the outer member 62. The connection 152 can permit the outer link 84 to pivot with respect to the outer member 62.

In an alternative embodiment, the second foldable arm 42 includes a pivoting connection between the outer link 84 and the outer member 62. The second foldable arm 42 including the telescoping portion 112 adjacent to the connection between the inner link 92 and the inner member 30.

In some embodiments, the telescoping portion 112 includes an inner portion (e.g, second member 232) and an outer portion (e.g., outer link 84). The inner portion is configured to retract, telescope or translate towards and away from the outer member 62 within the outer portion. In some embodiments, the outer portion includes a tubular portion (e.g., channel 216). The inner portion is configured to be disposed and retractable within the tubular portion. The inner portion can comprise various cross sectional shapes (e.g., square, circular, etc.). The tubular portion can comprise various cross sectional shapes (e.g., square, circular, etc.). The inner and tubular portions comprise the same telescoping cross sectional shapes in some embodiments. In other embodiments, the inner and tubular portions comprise different telescoping cross sectional shapes.

Figure 7A:
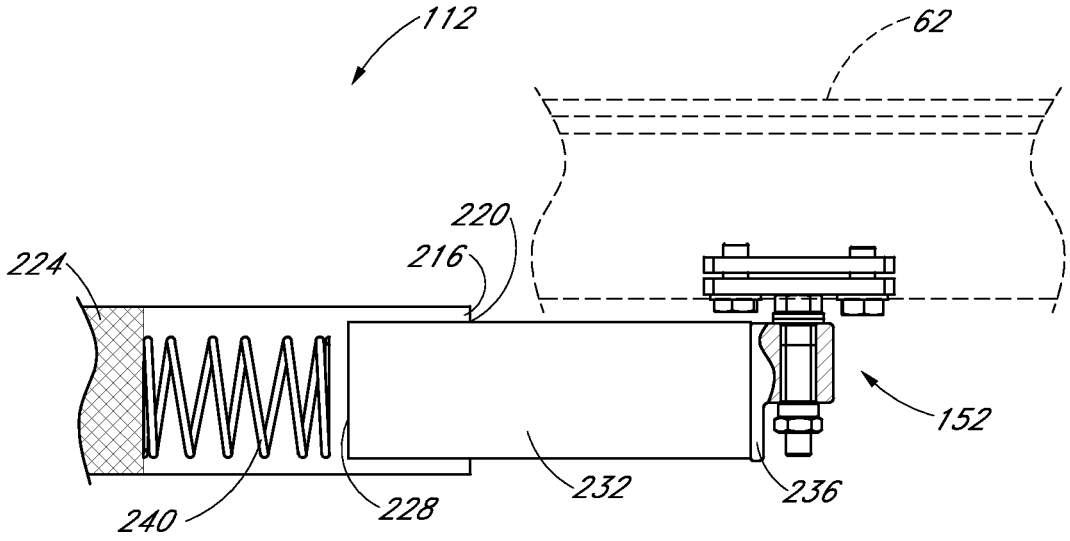
FIGS. 7A and 7B are cross cross-sectional views of an outer frame assembly of a feature 7A-7B from FIG. 16, showing a telescoping assembly used to control the folding operation of the awning.
Figure 7B:
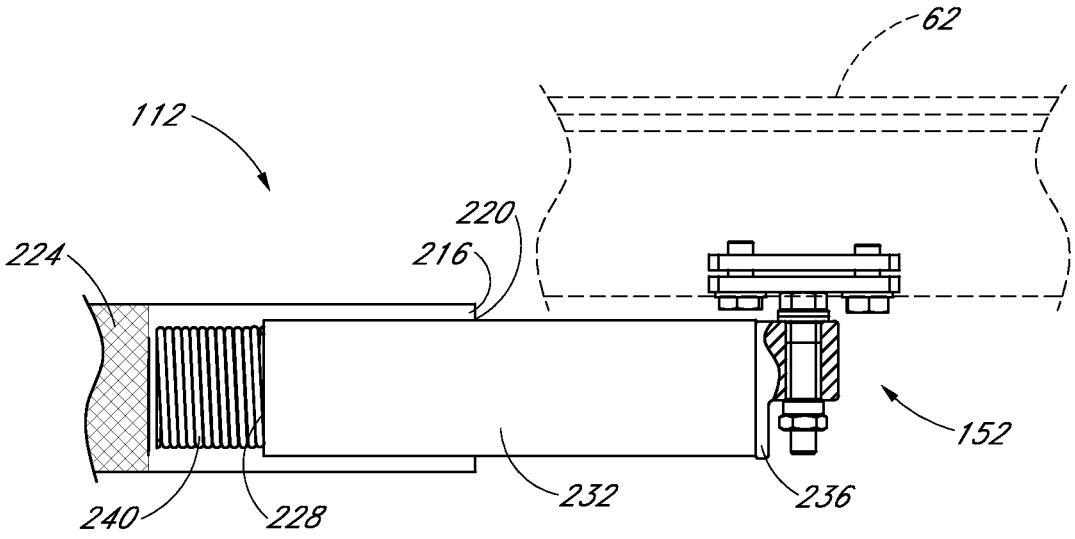
Figure 8:
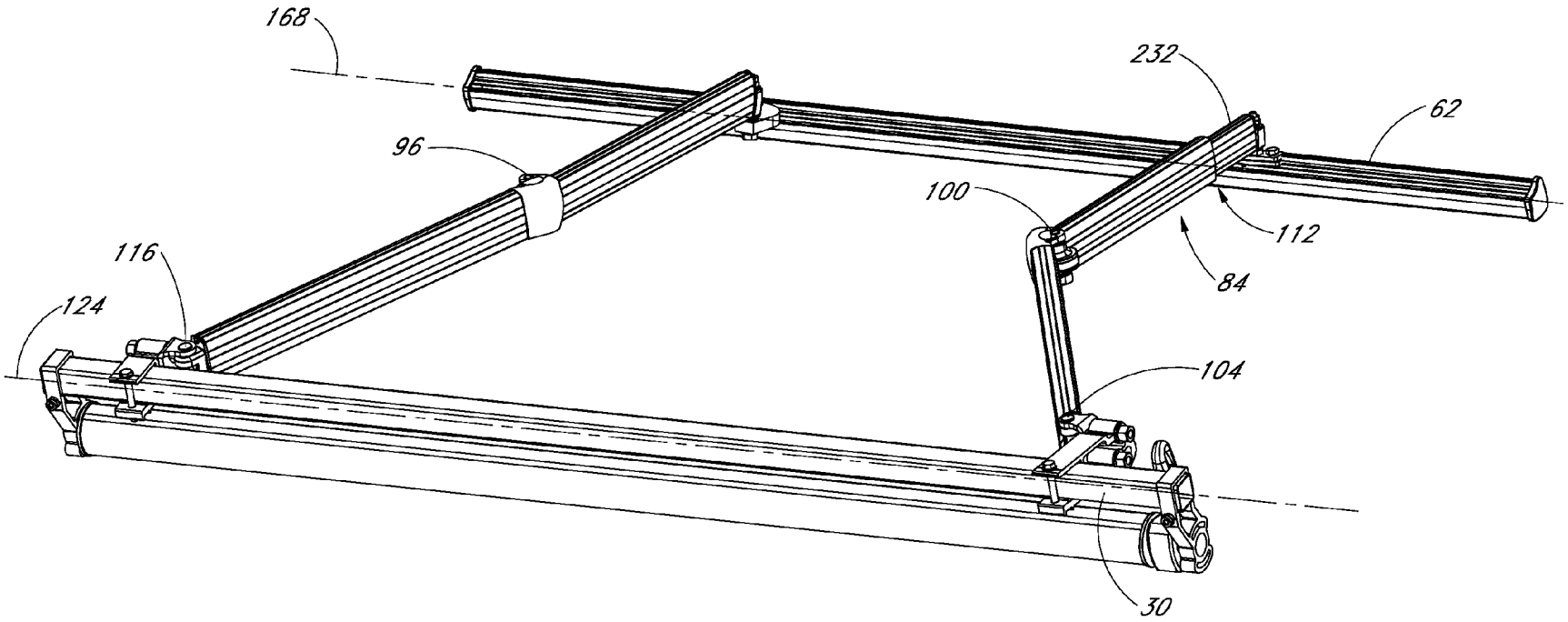
FIG. 8 is a rear perspective view of the embodiment of FIG. 6.

As depicted in FIGS. 7A-B, in some embodiments, the outer link 84 of the second foldable arm 42 includes a channel 216 extending within the outer link 84 from one end 220. Positioned within the channel 216 is a first member 224 (e.g., stop, plug, etc.). The first member 224 can be integrally or monolithically formed within the channel 216 or formed as a separate component. A first end 228 of a second member 232 is received within the channel 216. A second end 236 of the second member 232 is disposed outside the channel and coupled to the outer member 62 at the pivoting connection 152. A compressible member 240 (e.g., one or more springs, etc.) is disposed between the first member 224 and first end 228 of the second member 232. The compressible member 240 compresses during an initial retraction of the canopy 14 as the second member 232 retracts into the channel 216.

In some embodiments, upon initial retraction of the canopy 14, the second member 232 retracts or telescopes into the channel 216 and compresses the compressible member 236 against the first member 224 as shown in FIG. 7B. As discussed above, upon initial retraction of the canopy 14, the pivoting connections 116 and 120 induce first foldable arm 38 to fold during initial retraction of the canopy 14. Retraction of the second member 232 into the channel 216 minimizes or delays folding of the second foldable arm 42 relative to folding of the first foldable arm 38 during initial retraction of the canopy 14. Therefore, in some embodiments, the awning 10 is configured such that the first foldable arm 38 begins to fold prior to the second foldable arm 42 upon initial retraction of the awning 10.

The extent of retraction or movement of the telescoping portion 112 can be limited. In one embodiment, the second member 232 is configured to move along a longitudinal path having an end point within the channel 216. The end point can be defined by the first member 224 disposed within the channel 216 and the compressible member 236. As the canopy 14 is retracted, the second member 232 retracts or telescopes into the channel 216 and compresses the compressible member 236 against the first member 224. When the compressible member is fully compressed against the first member 224 by the second member 232, further retraction or longitudinal movement of the second member 232 within the channel 216 is prevented. Once the compressible member 236 has been fully compressed, pivoting about the pivoting connections 104, 100, 152 dominate the folding of the second foldable arm 42. The travel of the second member 232 between the position corresponding to fully extended until the second member 232 fully compresses the compressible member 236 against the first member 224 permits the second foldable arm 42 to be substantially fully extended while the first foldable arm 38 is folding. Upon reaching the end point of the travel path of the second member 232 (or the compressible member 236), the first foldable arm 38 will have moved into the bight 156 in a partially retracted state. Further retraction of the outer member 62 causes the angle between the inner link 92 and the inner member 30 to decrease. This change in angle causes the bight 156 to surround a smaller area, e.g., reducing the gap 280. As the bight 156 becomes more compact, at least a portion of the first foldable arm 38, e.g., at least the pivot 96 moves further into the bight 156.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An awning comprising:

a canopy having a width and an extended length when fully extended; and a canopy frame, the canopy frame comprising:

an inner member configured to be mounted to an upright support such as an exterior wall;

a first foldable arm and a second foldable arm, each of the arms including an inner portion coupled with the inner member, an outer portion, and a folding device joining the inner portion to the outer portion;

an outer member coupled with the outer portions of each of the first and second foldable arms;

a spacer coupled to the inner member and to the inner portion of the first foldable arm, the spacer comprising:

a first portion coupled with the inner member, a second portion coupled with the inner portion of the first foldable arm and, including a pivoting connection between the spacer and the inner portion of the first foldable arm, and an offset between the inner-most side of the inner member and the inner portion of the first foldable arm;

wherein a bight formed between the inner member, the spacer, and the first foldable arm upon retraction of the canopy, the bight at least partially receiving the second foldable arm, the offset being spaced to receive at least a folded size of the second foldable arm when in the retracted position.

2. The awning of claim 1, wherein each of the first and second foldable arms comprises a linkage including a plurality of links including an outer link coupled with the outer member and an inner link coupled with the inner member, each linkage including the folding device comprising a pivot joint between the inner and outer links.

3. The awning of claim 2, wherein the second foldable arm includes a pivoting connection between one of [a] the inner link and the inner member and [b] the outer link and the outer member, and a sliding connection between the other of [a] the inner link and the inner member and [b] the outer link and the outer member, wherein the sliding connection permits pivoting between the other of [a] the inner link and the inner member and [b] the outer link and the outer member.

4. The awning of claim 3, wherein the connection between the other of [a] the inner link and the inner member and [b] the outer link and the outer member permits the link and member to pivot with respect to each other.

5. The awning of claim 2, wherein the first foldable arm includes pivoting connections between the inner link and the inner member and between the outer link and the outer member.

6. The awning of claim 5, wherein the second foldable arm includes a pivoting connection between one of [a] the inner link and the inner member and [b] the outer link and the outer member, and a translatable connection between the other of [a] the inner link and the inner member and [b] the outer link and the outer member, wherein the translatable connection permits pivoting between the other of [a] the inner link and the inner member and [b] the outer link and the outer member.

7. The awning of claim 6, wherein a sliding joint is provided between the outer link and the outer member, the translatable connection includes a roller disposed in the outer member.

8. The awning of claim 5, wherein the second foldable arm includes a pivoting connection between one of [a] the inner link and the inner member and [b] the outer link and the outer member, and a telescoping portion adjacent to the connection between the other of [a] the inner link and the inner member and [b] the outer link and the outer member, wherein the connection permits pivoting between the other of [a] the inner link and the inner member and [b] the outer link and the outer member.

9. The awning of claim 8, the outer link comprising a tubular portion and a first member received within the tubular portion, wherein a compressible member is disposed between the first member received therein and a first end of a second member configured to translate towards and away from the first member, the compressible member compressing during an initial retraction of the canopy; wherein during the initial retraction, the first foldable arm is folded.

10. The awning of claim 1 wherein the canopy frame is configured such that upon initial retraction of the canopy, the first foldable arm begins folding prior to the second foldable arm.

11. The awning of claim 1 wherein the offset being spaced so that the inner and outer portions of the second foldable arm are substantially parallel when in the retracted position.

12. An awning comprising:

a canopy having a width and an extended length when fully extended; and a canopy frame, the canopy frame comprising:

an inner member configured to be mounted to an upright support such as an exterior wall;

a first foldable arm and a second foldable arm, each of the arms including an inner portion coupled with the inner member and an outer portion; and an outer member coupled with the outer portions of each of the first and second foldable arms;

wherein the canopy frame is configured such that upon initial retraction of the canopy, the first foldable arm begins folding prior to the second foldable arm; and wherein the second foldable arm includes a pivoting connection between one of [a] the inner link and the inner member and [b] the outer link and the outer member, and, a telescoping portion adjacent to the connection between the other of [a] the inner link and the inner member and [b] the outer link and the outer member.

13. An awning comprising:

a canopy having a width and an extended length when fully extended; and a canopy frame, the canopy frame comprising:

an inner member configured to be mounted to an upright support such as an exterior wall;

a first foldable arm and a second foldable arm, each of the arms including an inner portion coupled with the inner member and an outer portion;

an outer member coupled with the outer portions of each of the first and second foldable arms; and a spacer coupled to the outer member and to the outer portion of the first foldable arm, the spacer comprising a first portion coupled with the outer member and a second portion being off-set from the outer member and including a pivoting connection between the spacer and the outer portion of the first foldable arm;

wherein a bight is formed between, the outer member, the spacer, and the first foldable member upon retraction of the canopy, the bight at least partially receiving the second foldable arm.

14. The awning of claim 13, wherein the inner member extends along a longitudinal axis and the inner portion of the first foldable arm is coupled to the inner member to pivot about a first axis and the inner portion of the second foldable arm is coupled to the inner support member to pivot about a second axis, a first distance defined from the longitudinal axis of the inner member to the first axis, a second distance defined from the longitudinal axis of the inner member to the second axis, the second distance being greater than the first distance by an amount greater than the folded size of the first foldable arm.

15. The awning of claim 13, wherein a connection between the second foldable arm and one of the inner member and the outer member minimizing folding of the second arm during an initial retraction of the canopy, and wherein a connection between the first foldable arm and one of the inner member and the outer member induces folding of the first arm during the initial canopy retraction.

16. The awning of claim 13, wherein each of the first and second foldable arms comprises a pivot disposed in a central portion thereof; wherein when the awning is extended the pivot of the first foldable arms is in a first position disposed laterally of the second arm and when the awning is retracted the pivot of the first foldable arm is in a second position disposed between the second arm and the inner member.

17. The awning of claim 13, wherein when the awning is retracted a pivot of the second foldable arms is disposed between the first arm and the outer member.

18. The awning of claim 13, wherein when the canopy frame is configured such that when the canopy is retracted, the first and second foldable arms overlap each other in a generally horizontal plane.

19. An awning comprising:

a canopy having a width and an extended length when fully extended; and a canopy frame, the canopy frame comprising:

an inner member configured to be mounted to an upright support such as an exterior wall;

a first foldable arm and a second foldable arm, each of the arms including an inner portion coupled with the inner member and an outer portion; and an outer member coupled with the outer portions of each of the first and second foldable arms;

wherein the canopy frame is configured such that when the canopy is retracted, the first and second foldable arms overlap each other in a generally horizontal plane wherein the first arm is pivotally connected to the inner member at a first inner pivot and is pivotally connected to the outer member at a first outer pivot, the second arm is pivotally connected to the inner member at a second inner pivot and is pivotally connected to the outer member at a second outer pivot, wherein the distance from the inner member to the first inner pivot is less than the distance from the inner member to the second inner pivot and the distance from the outer member to the first outer pivot is greater than the distance from the outer member to the second outer pivot.

20. The awning of claim 19, wherein the second foldable arm is coupled with the outer member at the second outer pivot and rotates about an axis that extends through the outer member.

21. An awning comprising:

a canopy having a width and an extended length when fully extended; and a canopy frame, the canopy frame comprising:

an inner member configured to be mounted to an upright support such as an exterior wall;

a first foldable arm and a second foldable arm, each of the arms including an inner portion coupled with the inner member and an outer portion, each of the outer portions coupled to corresponding inner portions at a pivot coupling;

an outer member coupled with the outer portions of each of the first and second foldable arms;

a first coupling having an outer portion coupled with the outer member and an inner portion coupled with the outer portion of the first foldable arm at a first offset location, the first offset location spaced inward of the inner-most side of the outer member and comprising a first outer pivot defining a first pivot axis; and a second coupling coupled to the outer portion of the second foldable arm and comprising a second outer pivot disposed on the outer member and defining a second pivot axis intersecting the outer member;

wherein the canopy frame is configured such that when the canopy is retracted, the first and second foldable arms overlap each other in a generally horizontal plane.

* * * * *